United States Patent [19]

Nishi et al.

[11] 4,045,159

[45] Aug. 30, 1977

[54] COMBUSTION APPARATUS

[75] Inventors: Atsuyoshi Nishi; Katuo Yashiro, both of Nakatsugawa, Japan

[73] Assignee: Mitsubishi Denki Kabushiki Kaisha, Tokyo, Japan

[21] Appl. No.: 600,378

[22] Filed: July 30, 1975

[30] Foreign Application Priority Data

July 30, 1974 Japan ..... 49-90976[U]
July 30, 1974 Japan ..... 49-90980[U]

[51] Int. Cl.[2] ..... F23D 13/40

[52] U.S. Cl. ..... 431/328; 431/354; 60/39.74 S; 60/39.11

[58] Field of Search ..... 60/39.71, 39.74 R, 39.74 S, 60/39.69, 39.65, 39.11; 431/326, 328, 168, 139, 329, 353, 354; 239/214, 214.25, 432, ; 261/84, 90

[56] References Cited

U.S. PATENT DOCUMENTS

| | | | |
|---|---|---|---|
| 2,551,112 | 5/1951 | Goddard | 60/39.11 |
| 2,551,115 | 5/1951 | Goddard | 60/39.11 |
| 2,559,792 | 7/1951 | Pietri | 60/39.74 S |
| 3,155,142 | 11/1964 | Stack | 431/328 |
| 3,418,979 | 12/1968 | Reichmann | 431/328 |
| 3,853,456 | 12/1974 | Mutchler | 431/168 |
| 3,859,786 | 1/1975 | Azelborn | 60/39.65 |

*Primary Examiner*—Carlton R. Croyle
*Assistant Examiner*—L. J. Casaregola
*Attorney, Agent, or Firm*—Oblon, Fisher, Spivak, McClelland & Maier

[57] ABSTRACT

A combustion apparatus having a mixing chamber, a combustion chamber, a flame holes plate disposed therebetween for forming a combustion flame at a flame projecting aperture thereof, a choke plate on the mixing chamber side of the flame holes plate in concentric relation thereto and having a central opening smaller than that of the flame holes plate for the purpose of keeping the velocity of the mixed combustible gas lower at the periphery than at the central parts, and a mixing impeller having central openings for directly passing part of the air provided for combustion to the central part of the choke plate opening for the purpose of increasing the concentration of the mixed combustible gas at the peripheral parts of the flame holes plate in the combustion chamber.

5 Claims, No Drawings

COMBUSTION APPARATUS

BACKGROUND OF THE INVENTION

The present invention relates generally to combustion apparatus of the type wherein a liquid fuel is vaporized and such vaporized fuel gas is mixed with air for combustion and the mixed combustible gas is then injected into a combustion chamber to complete the combustion. More particularly, the present invention is directed to an improved flame hole plate for use in such combustion apparatus.

In combustion apparatus of the type characterized herein where the fuel oil is vaporized and is injected into the combustion chamber to complete the combustion, it is the usual practice to feed all of the air for combustion as a primary air after first preheating such air so as to prevent condensation of the vaporized fuel and to improve the ignition property thereof. As such, it has been found that the combustion flame of such apparatus is unstable in the vicinity of the flame holes plate presently utilized thereon, when compared with combustion apparatus characterized by the separate feeding of air for combustion as a primary air and a secondary air to form to stable combustion flame.

SUMMARY OF THE INVENTION

It is therefore an object of the present invention to provide an improved combustion apparatus of the character described herein for forming a stable combustion flame.

It is another object of the present invention to provide an improved construction of a flame holes plate for practical use in such combustion apparatus for improving the stability of the combustion flame.

The foregoing and other objects are achieved according to the combustion apparatus of the present invention through the provision of a porous plate positioned adjacent to a choke plate, the choke plate having an opening which is smaller than the flame projecting aperture of the flame holes plate and being arranged in concentric relation on the mixing chamber side of the flame holes plate, whereby the velocity of the mixed combustible gas injected from the mixing chamber through the opening of the choke plate, the porous plate and the flame projecting aperture of the flame holes plate to the combustion chamber at the peripheral region thereof is lower than that at the central region. The combustion apparatus of the invention further comprises a mixing impeller, for mixing the fuel and the air for combustion, which faces the choke plate with a predetermined space provided therebetween, being disposed in the mixing chamber, and has a communicating hole formed near the center thereof for directly passing a part of the air for combustion being fed into the mixing chamber to the central part of the opening of the choke plate, whereby the concentration of the fuel in the mixed combustible gas injected from the mixing chamber through the opening of the choke plate, the porous plate and the flame projecting aperture of the flame holes plate to the combustion chamber at the peripheral parts thereof is higher than that at the central parts thereof, and the combustion flame formed at the flame projecting aperture of the flame holes plate on the side of the combustion chamber at the central part thereof is kept in the condition similar to the lifting, and the main combustion flame is kept in the lifting condition, so as to prevent back firing, and the combustion flame is attracted to the flame projecting aperture of the flame holes plate at the peripheral part thereof so as to form a stable combustion flame.

BRIEF DESCRIPTION OF THE DRAWINGS

Various other objects, features and attendant advantages of the combustion apparatus of the present invention will be more fully appreciated as the same becomes better understood from the following detailed description, when considered in connection with the accompanying drawings, in which like reference numerals designate like or corresponding parts through the several views, and wherein.

DETAILED DESCRIPTION OF THE PREFERRED EMBODIMENT

Figure 1:
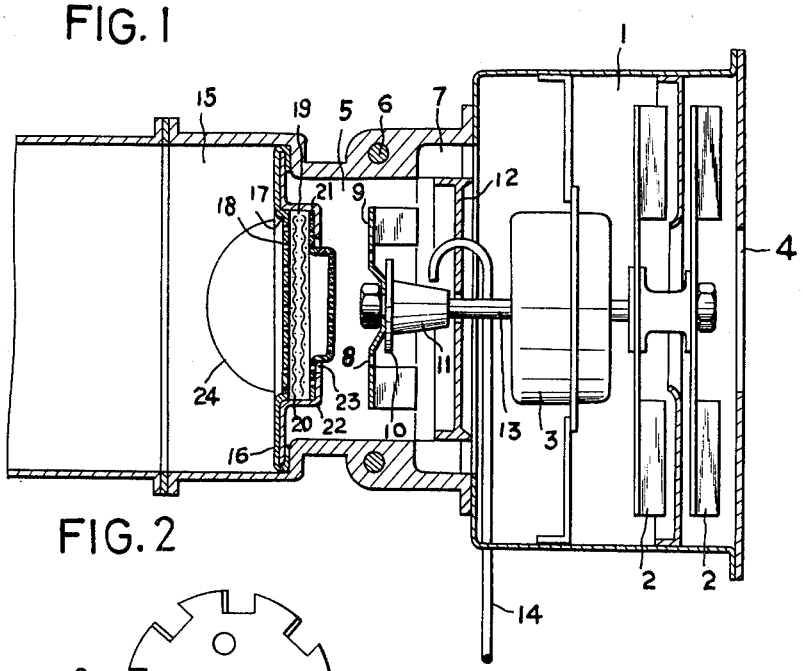
FIG. 1 is a sectional view of one embodiment of a combustion apparatus constructed according to the present invention.

Referring now to the drawings, and more particularly to FIG. 1 thereof, there is shown an air chamber 1 defined by a housing, preferably made of steel, having disposed therein a blast impeller 2 and a driving motor 3 therefor. An air inlet 4 is provided in one side surface of the housing. A mixing chamber 5 is provided within a substantially tubular wall, preferably made of aluminum, which is disposed immediately adjacent to the housing defining the air chamber 1, being illustrated as being disposed against the side wall thereof opposite the air inlet 4.

Figure 2:
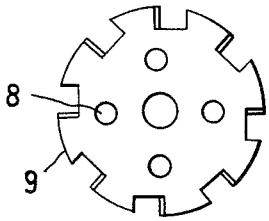
FIG. 2 is a front view of a mixing impeller employed in the combustion apparatus shown in FIG. 1.

An electric heater 6 is laid in the wall of the mixing chamber 5 at the center thereof. An air passage 7 in the partition wall between the mixing chamber 5 and the air chamber 1 provides communication therebetween. Centrally disposed within the mixing chamber 5 is a mixing impeller 9, having a plurality of apertures or holes 8 arranged in a circle therein inside the blades thereof, and a rotor 11, having a circular-truncated cone shape with a flange 10 at the impeller end thereof, as shown in FIG. 2, the rotor serving to drive the impeller. The mixing impeller 9 and the driving rotor 11 thereof are secured to the end of a shaft 13 of the motor 3, the drive shaft of which projects through a partition wall 12 between the air chamber 1 and the mixing chamber 5.

An outlet of a pipe 14 for feeding the liquid fuel faces the side of the rotor 11 with a predetermined gap provided therebetween, and the pipe 14 extends through the partition wall 12 and the wall of the air chamber 1 to the outdoors where the inlet thereof is connected to a liquid fuel feeder, not shown.

A combustion chamber 15 disposed adjacent to the mixing chamber 5 on the side thereof opposite the air chamber 1 is defined by a wall which includes an extended part of the aluminum wall of the mixing chamber 5 and a cylinder portion, preferably made of steel, connected to the edge of such extended part. Arranged between the mixing chamber 5 and the combustion chamber 15 is a flame holes plate 16, preferably made of stainless steel, having a flame projecting aperture portion 17 formed therein by collapsing the same at its center, with many fine holes 18 being formed by etching with an acid on the bottom or base of the flame projecting aperture portion 17.

A plurality of porous plates 19, which are composed of piled wire gauzes 20, are disposed on the mixing chamber side of the flame holes plate 16, being held in place by a plate 21, preferably made of copper or nickel, which has many fine holes formed therein. The plate 21 is secured about its periphery against the porous plates 19 by a choke plate 22 and has a collapsed central portion which extends through a central opening 23 in the choke plate, which opening is smaller than the flame projecting aperture 17 of the flame holes plate 16. The peripheral part of the choke plate is held in place by folding the peripheral part of the flame holes plate 16 inwards and thereabout.

The operating of the combustion apparatus of the present invention and being constructed in the manner illustrated will now be described.

When a liquid fuel, such as, for example, kerosene, is fed through the pipe 14 for fuel oil by the feeder (in the case of a heating coefficient of about 8,000–2,000 K cal/hour, the feed rate of the liquid fuel is about 0.3–0.08 cc/second), the fuel oil falls upon the rotor 11 which is rotated by the motor 3 in dropwise fashion to flow along the slant surface of the peripheral part thereof, being scattered from the flange 10 to the wall of the mixing chamber 5, which is heated to a temperature of about 250° C by the electric heater 6. The liquid fuel is thus vaporized.

On the other hand, air for combustion is fed by the blast impellers 2, 2, which are rotated by the motor 3, from the air inlet 4 to the air chamber 1, from which it is fed through the air passage 7 to the mixing chamber 5 under preheating conditions. The vaporized fuel being fed, as indicated, and the air for combustion being supplied, as indicated, are mixed by the mixing impeller 9. This mixed combustible gas is then passed through the opening 23 of the choke plate 22 and the plurality of porous plates 19, including the formed metal plate 21 and the wire gauzes 20, 20, and is injected from the many fine holes 18 of the flame projecting aperture 17 of the flame holes plate 16 into the bottom of the combustion chamber 15. A combustion flame 24 is formed at the flame projecting aperture 17 of the flame holes plate 16, as indicated in FIG. 1, by igniting an ignitor, which is not shown.

Figure 3:
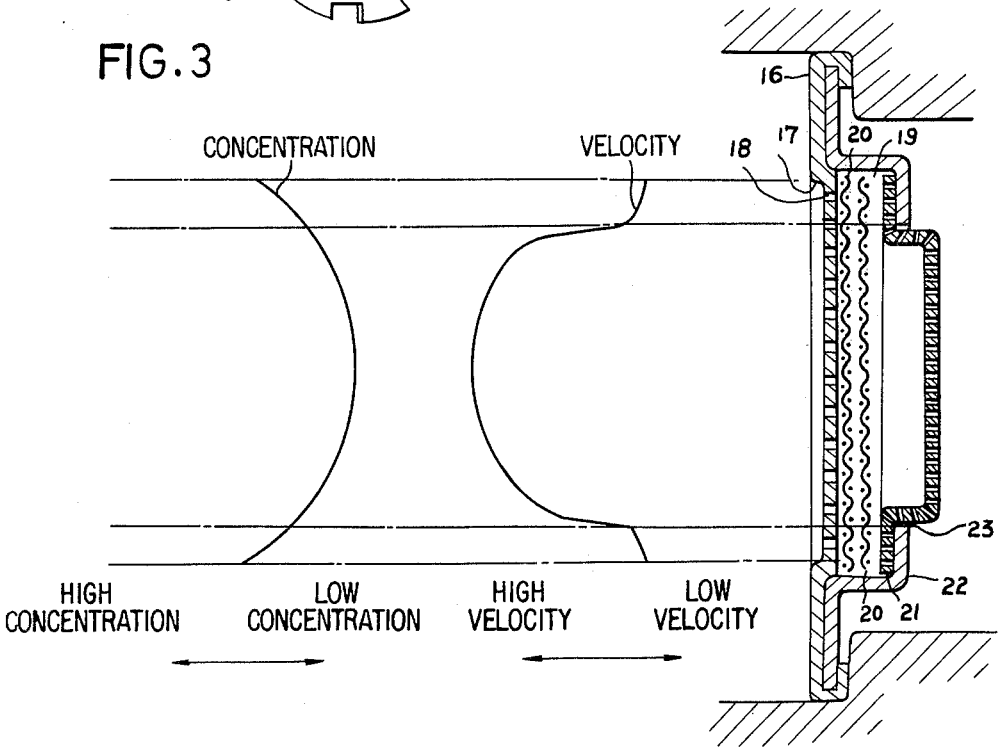
FIG. 3 is a sectional view of a plate having a plurality of flame holes therein as employed in the combustion apparatus shown in FIG. 1 and a graph for illustrating the relation of the injecting velocity of a mixed combustible gas and the concentration of a fuel in the mixed combustible gas.

As shown in the graph of FIG. 3, the mixed combustible gas injected from the flame projecting aperture 17 of the flame holes plate 16 is injected by passing from the opening 23 of the choke plate 22, having a diameter smaller than that of the flame projecting aperture 17 of the flame holes plate 16. Accordingly, the velocity of the mixed combustible gas being fed from the peripheral part of the opening 23 of the choke plate 22 is decreased at the porous plate 19 under spreading of the gas to the peripheral part thereof (0.3 m/second), while the velocity of the mixed combustible gas being injected from the center of the flame projecting aperture 17 of the flame holes plate 16 is increased (3 m/second). With regard to the concentration of the fuel in the mixed combustible gas injected from the flame projecting aperture 17 of the flame holes plate 16, the concentration of the fuel at the peripheral part (excess rate of the air for combustion is 1.1–1.2 times the theoretical rate of air) is higher than that at the central part of the flame projecting aperture 17 of the flame holes plate 16 (excess rate of the air for combustion is 1.4–1.5 times the theoretical rate of air) because a part of the air of combustion is directly fed through the communicating holes 8 at the center of the mixing impeller 9 to the central part of the opening 23 of the choke plate 22.

Accordingly, in accordance with the combustion apparatus of the invention, the structure of the flame holes plate 16 imparts the function of decreasing the velocity of the mixed combustible gas injected from the flame projecting aperture 17 of the flame holes plate 16 at the peripheral part, whereby back firing can be prevented, though it is usual to cause back firing by increasing the velocity of air for combustion when the injecting velocity of the mixed combustible gas at the flame projecting aperture 17 of the flame holes plate 16 at the central part is increased to cause lifting. As a result, the velocity of the mixed combustible gas at the peripheral part can be maintained so as to cause back firing, whereby the combustion flame formed at the central part is attracted to the flame projecting aperture 17 of the flame hole plate 16 by the combustion flame formed at the peripheral part so as to keep a stable condition as a whole of the combustion flame.

The concentration of the fuel in the mixed combustible gas injected from the flame projecting aperture 17 of the flame holes plate 16 at the peripheral part is higher than that at the central part. Accordingly, back firing can be prevented by the communicating holes 8 of the mixing impeller 9 so as to provide relatively low concentration and to cause lifting at the central part of the mixed combustible gas injected from the flame projecting aperture 17 of the flame holes plate 16. As a result, in this case, the concentration of the fuel at the peripheral part is high so as to cause back firing, whereby the combustion flame formed at the central part is attracted to the flame projecting aperture 17 of the flame holes plate 16 by the combustion flame formed at the peripheral part so as to keep a stable condition as a whole of the combustion flame.

Figure 4:
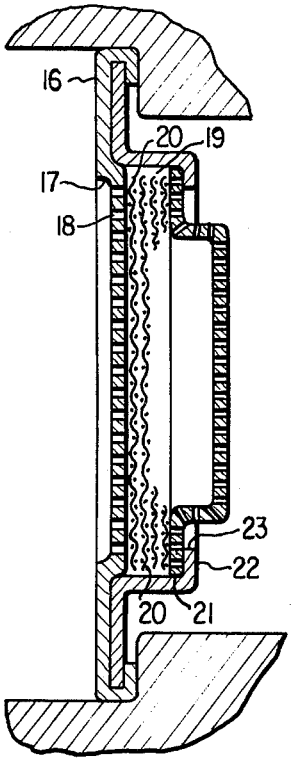
FIG. 4 is a sectional view of an embodiment of a flame holes plate, choke plate and porous plates arrangement differing from that shown in FIGS. 1 and 3.

In the embodiment shown in the drawings, many fine holes 18 are formed in the base of the flame projecting aperture 17 of the flame holes plate 16. However, it is possible to prepare a separate plate, if desired, having many fine holes and to place it on the flame holes plate 16. In the illustrated embodiment, a plurality of plates, such as the wire gauzes 20, 20 and the foamed metal plate, are used as the porous plates 19. However, it is possible to prepare the porous plate as one plate by using a plate having many holes. Also, in the illustrated embodiment, the opening 23 of the choke plate 22 is smaller than the flame projecting aperture 17 of the flame holes plate 16. However, it is possible that the size of the flame projecting aperture 17 of the flame holes plate 16 can be the same as that of the opening 23 of the choke plate 22, with the thickness of the peripheral part of the porous plate 19 being greater than that of the central part as shown in FIG. 4, whereby the velocity of the mixed combustible gas injected from the flame projecting aperture 17 at the peripheral part is lower than that at the central part, in the same manner as described.

Obviously many other modifications and variations of the invention are possible in light of these teachings. It is therefore to be understood that within the scope of the appended claims, the invention can be practiced otherwise than as specifically described herein.

What is claimed as new and desired to be secured by Letters Patent of the United Stated is:

1. A combustion apparatus which comprises:

a mixing chamber for mixing a fuel and air for combustion separately introduced thereinto;

a combustion chamber for combustion of the mixed combustible gas being disposed adjacent to said mixing chamber;

a flame holes plate disposed between said mixing chamber and said combustion chamber for forming a combustion flame at a flame projecting aperture of said flame holes plate by injecting the mixed combustible gas from said mixing chamber therethrough to said combustion chamber; and foraminous means disposed immediately adjacent said flame holes plate for uniformly maintaining the velocity of the mixed combustible gas injected from said mixing chamber through the flame projecting aperture of said flame holes plate to the combustion chamber over the entire peripheral part thereof lower than that at the central part thereof, wherein said velocity maintaining means comprises;

a porous plate between said flame holes plate and said mixing chamber; and a choke plate having an opening which is smaller than said flame projecting aperture of said flame holes plate and being concentrically positioned on the mixing chamber side of said flame holes plate and said porous plate, whereby the velocity of said mixed combustible gas injected from said mixing chamber through said opening of said choke plate, said porous plate and said flame projecting aperture of said flame holes plate to the combustion chamber is lower at the peripheral parts thereof than at the central parts thereof.

2. A combustion apparatus which comprises:

a mixing chamber for mixing a fuel and air for combustion;

a combustion chamber for combustion of the mixed combustible gas being disposed adjacent to said mixing chamber;

a flame holes plate disposed between said mixing chamber and said combustion chamber for forming a combustion flame at a flame projecting aperture of said flame holes plate by injecting the mixed combustible gas from said mixing chamber therethrough to said combustion chamber;

a porous plate between said flame holes plate and said mixing chamber;

a choke plate having a central opening and being disposed in concentric relation to the flame holes plate on the mixing chamber side of said flame holes plate and said porous plate; and means for maintaining the concentration of the air in the mixed combustible gas injected from said mixing chamber through said opening of said choke plate, said porous plate and said flame projecting aperture of said flame holes plate to said combustion chamber at the central parts thereof higher than at the peripheral parts thereof.

3. A combustion apparatus according to claim 2, wherein said means for maintaining the concentration of fuel comprises:

a mixing impeller for mixing the fuel and the air for combustion being disposed in said mixing chamber to face said choke plate in predetermined spaced relationship therewith; and a communicating hole formed in the central part of said mixing impeller for directly passing a part of the air for combustion fed into said mixing chamber to the central part of said opening of said choke plate.

4. A combustion apparatus according to claim 2, wherein the size of the opening of the choke plate is the same as the flame projecting aperture of the flame holes plate and the thickness of the porous plate at the peripheral part thereof is greater than that at the central part thereof.

5. A combustion apparatus according to claim 2, wherein the central opening of said choke plate is smaller than said flame projecting aperture of said flame holes plate, whereby the velocity of the mixed combustible gas injected from said mixing chamber through said opening of said choke plate, said porous plate and said flame projecting aperture of said flame holes plate to the combustion chamber at the peripheral parts thereof is lower than that at the central parts thereof.

* * * * *